US006382320B1

(12) United States Patent
Tilbrook et al.

(10) Patent No.: US 6,382,320 B1
(45) Date of Patent: May 7, 2002

(54) METHOD AND SYSTEM FOR OFFSHORE PRODUCTION OF HYDROCARBON FLUIDS

(75) Inventors: Andrew Peter Tilbrook, West Sussex; David Bone, Monmouthshire; Ian Allard, Surrey; Robert Eden, Manchester, all of (GB)

(73) Assignee: McDermott Marine Construction Limited, Wembley (GB)

( * ) Notice: Subject to any disclaimer, the term of this patent is extended or adjusted under 35 U.S.C. 154(b) by 0 days.

(21) Appl. No.: 09/446,785

(22) PCT Filed: Jun. 26, 1998

(86) PCT No.: PCT/GB98/01874

§ 371 Date: Jun. 12, 2000

§ 102(e) Date: Jun. 12, 2000

(87) PCT Pub. No.: WO99/00579

PCT Pub. Date: Jan. 7, 1999

(30) Foreign Application Priority Data

Jun. 27, 1997 (GB) ..... 9713737

(51) Int. Cl.[7] ..... E21B 29/12

(52) U.S. Cl. ..... 166/350; 166/359; 405/224.2

(58) Field of Search ..... 405/224.2; 166/350, 166/357, 359, 367

(56) References Cited

U.S. PATENT DOCUMENTS 4,231,681 A * 11/1980 Tuson ..... 405/195
6,263,971 B1 * 7/2001 Giannesini ..... 166/366

* cited by examiner

*Primary Examiner*—William Neuder
(74) *Attorney, Agent, or Firm*—D. Neil LaHaye; Eric Marich

(57) ABSTRACT

This application discloses a method of extracting hydrocarbons from a submarine well, which is characterized in that a displacement fluid, e.g. water, is injected under pressure into the submarine well, or into a reservoir connected to the submarine well, from a submerged buoy or from a submerged part of a buoy. Typically, the injection fluid is rawwater. A buoy is also disclosed which comprises an upper section (2) arranged to extend above the sea level; and a lower, submerged section (1), characterized in that the lower, submerged section comprises means for providing a displacement fluid under pressure to an output which is connected or is connectable to a submarine well.

28 Claims, 1 Drawing Sheet

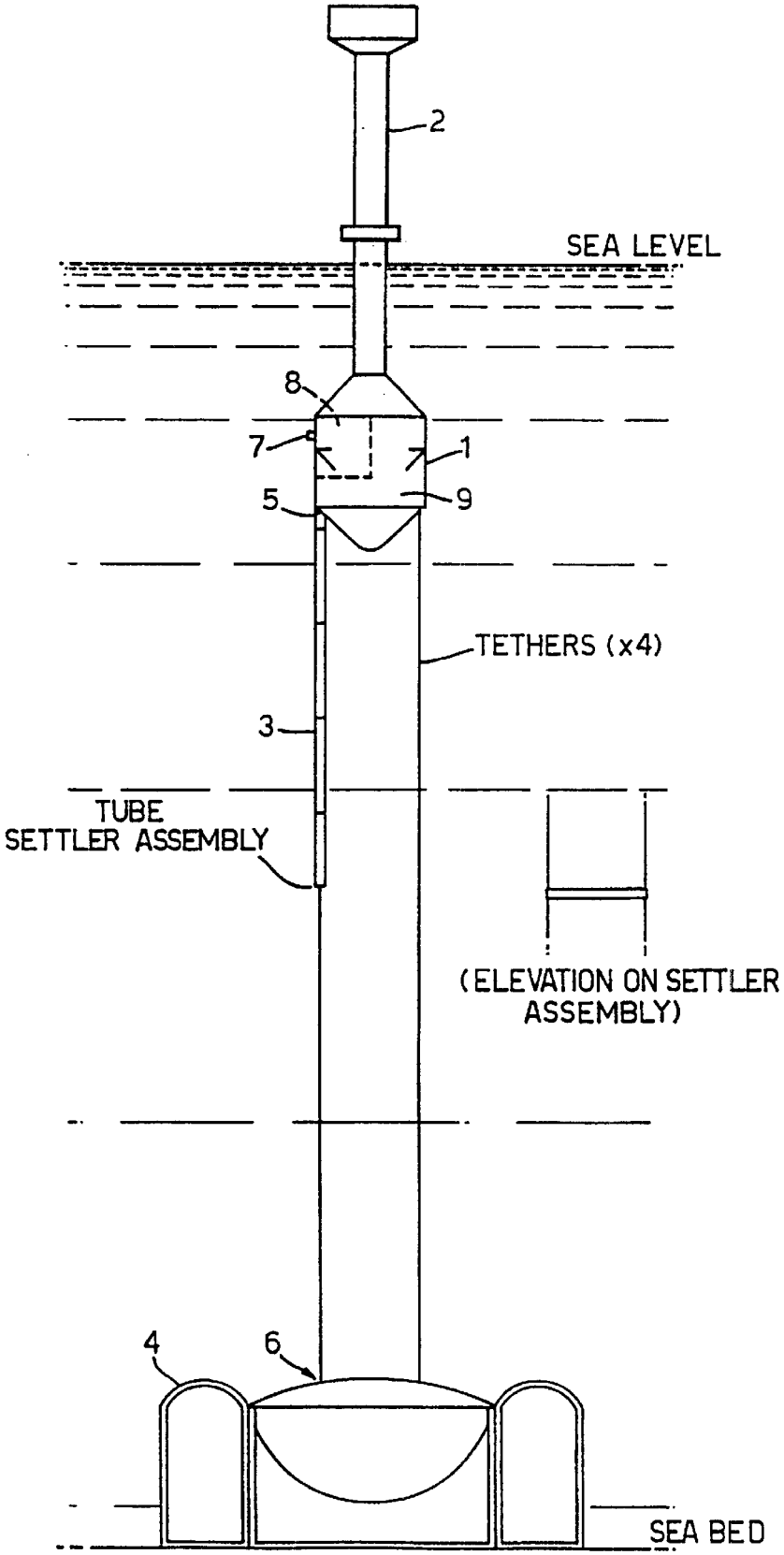
2
SEA LEVEL
8
7
1
5
9
TETHERS (x4)
3
TUBE
SETTLER ASSEMBLY
(ELEVATION ON SETTLER
ASSEMBLY)
4
6
SEA BED

METHOD AND SYSTEM FOR OFFSHORE PRODUCTION OF HYDROCARBON FLUIDS

This invention relates to the offshore production of hydrocarbon fluids and more particularly but not exclusively is concerned with means for assisting the extraction of hydrocarbons by pumping a displacement fluid directly or indirectly into the submarine source.

According to one aspect of the present invention, there is provided an apparatus for offshore production of hydrocarbon fluids, comprising a base and a buoyant structure secured to said base and connected or adapted to be connected to a subsea well or wells, characterised in that: (A) said buoyant structure is tethered to said base by a plurality of flexible tethers; (B) a flexible riser is provided between said base and said buoyant structure; and (C) said buoyant structure comprises a submerged section comprising means for providing a displacement fluid under pressure to an output which communicates with said base via said flexible riser.

Advantageously, the base is adapted to function as a storage vessel. The buoyant structure can comprise an upper section which extends above the sea level.

In another aspect, the invention provides a method of extracting hydrocarbons from a submarine well, which is characterised in that a displacement fluid, e.g. water, is injected under pressure into the submarine well, or into a reservoir connected to the submarine well, from a submerged buoy or from a submerged part of a buoy.

Conveniently, the displacement fluid is rawwater (untreated or minimally treated seawater). Optionally, the rawwater can be treated prior to use; normally such treatment will involve a deoxygenation process.

According to another aspect of the present invention, there is provided a buoy which comprises an upper section arranged to extend above the sea level; and a lower, submerged section, characterised in that the lower, submerged section comprises means for providing a displacement fluid under pressure to an output which is connected or is connectable to a submarine well.

In the apparatus and buoy as defined above, the means for providing a displacement fluid is preferably a pump or a series of pumps capable of delivering fluid at an output pressure in the range of 500 to 5,000 psi. The presently preferred operating pressure is 3,000 psi.

Power for operating the pump(s) may be provided by a generating system mounted in or on the buoyant structure.

The connection to the submarine well is preferably by means of one or more flexible risers. These may be connected directly to the wellhead, e.g. through a water injection manifold or a tree flowbase, or via a storage structure located at or close to the wellhead. Preferably the displacement fluid is water, e.g. rawwater or deoxygenated rawwater.

In one embodiment, the buoy of this invention provides pressurised water for injection into two or more submarine wells, e.g. via a pair of flexible risers which diverge at or close to the seabed to reach the submarine wells.

For a better understanding of the invention, reference will now be made, by way of example, to the accompanying drawing, which shows a diagrammatical view of a buoy in accordance with the invention tethered to a base structure.

Referring now to the drawing, the buoy comprises an lower section 1 and an upper section 2. As shown, the lower section 1 is submerged. A tube section assembly constitutes a flexible riser 3 which extends between an output 5 of the lower section 1 and an inlet 6 of a base structure 4. The base 4 sits on the sea bed, as shown. Alternatively, the riser 3 may be connected directly to a wellhead (not shown).

The submerged, lower section 1 of the buoy contains an inlet 7 for sea water and a processing system 8 for deoxygenating (partially or completely) the water. Treated water is then passed to a pumping system 9 which delivers water to outlet 5 at a pressure of 3,000 psi. Power for the processing system 8 and the pumping system 9 is provided by a generating system (not shown) which may be located in either of the sections of the buoy 1,2.

In a preferred mode of operation, oil extracted from a submarine well (not shown) is supplied to the base structure 4, which acts as a storage vessel and, where desired, as an oil/water separating system. Water from outlet 5 of the buoy is fed at a pressure of 3,000 psi through riser 3 to the wellhead, where it replaces extracted oil, thus leading to enhanced oil production.

What is claimed is:

1. An apparatus for offshore production of hydrocarbon fluids from a subsea well, comprising:

a base structure adapted to rest on a sea bed;

a buoyant structure secured to said base structure and adapted to be connected to a subsea well, said buoyant structure having a submerged section with an output and means for providing a displacement fluid under pressure to the output;

a plurality of flexible tethers connected between said buoyant structure and said base structure for tethering said buoyant structure to said base structure;

a flexible riser connected between said output of said buoyant structure and said base structure for supplying the displacement fluid under pressure to said base structure via said flexible riser.

2. An apparatus as claimed in claim 1, wherein buoyant structure is connected to a subsea well.

3. An apparatus as claimed in claim 1, wherein said base structure comprises a storage vessel for hydrocarbon fluids.

4. An apparatus as claimed in claim 2, wherein said base structure is adapted to function as a storage vessel for hydrocarbon fluids.

5. An apparatus as claimed in claim 1, wherein said buoyant structure further comprises an upper section adapted to extend above sea level, said upper section being connected to said submerged section.

6. An apparatus as claimed in claim 2, wherein said buoyant structure further comprises an upper section adapted to extend above sea level, said upper section being connected to said submerged section.

7. An apparatus as claimed in claim 3, wherein said buoyant structure further comprises an upper section adapted to extend above sea level, said upper section being connected to said submerged section.

8. An apparatus as claimed in claim 1, wherein said means for providing a displacement fluid comprises at least one pump that is capable of delivering fluid at an output pressure in the range of 500 to 5,000 psi.

9. An apparatus as claimed in claim 2, wherein said means for providing a displacement fluid comprises at least one pump that is capable of delivering fluid at an output pressure in the range of 500 to 5,000 psi.

10. An apparatus as claimed in claim 3, wherein said means for providing a displacement fluid comprises at least one pump that is capable of delivering fluid at an output pressure in the range of 500 to 5,000 psi.

11. An apparatus as claimed in claim 4, wherein said means for providing a displacement fluid comprises at least one pump that is capable of delivering fluid at an output pressure in the range of 500 to 5,000 psi.

12. An apparatus as claimed in claim 1, wherein said buoyant structure includes a generating system for providing power to drive said means for providing said displacement fluid.

13. An apparatus as claimed in claim 2, wherein said buoyant structure includes a generating system for providing power to drive said means for providing said displacement fluid.

14. An apparatus as claimed in claim 3, wherein said buoyant structure includes a generating system for providing power to drive said means for providing said displacement fluid.

15. An apparatus as claimed in claim 4, wherein said buoyant structure includes a generating system for providing power to drive said means for providing said displacement fluid.

16. An apparatus as claimed in claim 5, wherein said buoyant structure includes a generating system for providing power to drive said means for providing said displacement fluid.

17. A method of extracting hydrocarbons from a submarine well, comprising: injecting a displacement fluid under pressure from an output of a buoyant structure to a base structure at a sea bed, through a flexible riser connected between the buoyant structure and the base structure.

18. A method according to claim 17, including providing rawwater as said displacement fluid.

19. A method according to claim 17, including deoxygenating sea water to form said displacement fluid.

20. A method according to claim 17, including injecting the displacement fluid under pressure into a reservoir in the base structure which is connected to the submarine well, from a submerged part of the buoyant structure.

21. A method according to claim 20, including injecting rawwater as said displacement fluid.

22. A method according to claim 20, including deoxygenating sea water and injecting the deoxygenated sea water as said displacement fluid.

23. A buoy comprising: an upper section for extending above sea level; a lower, submerged section connected to the upper section, the submerged section comprising means for providing a displacement fluid under pressure to an output of the submerged section and adapted to be connected to a submarine well, and a flexible riser connected to the output for connecting the output to a base structure for receiving the displacement fluid.

24. A buoy as claimed in claim 23, wherein the means for providing a displacement fluid is at least one pump capable of delivering fluid at an output pressure in the range of 500 to 5,000 psi.

25. A buoy as claimed in claim 23, including a generating system for providing power to drive the means for providing said displacement fluid.

26. A buoy as claimed in claim 23, wherein the output is connected to a submarine well.

27. A buoy as claimed in claim 26, wherein the means for providing a displacement fluid is at least one pump capable of delivering fluid at an output pressure in the range of 500 to 5,000 psi.

28. A buoy as claimed in claim 26, including a generating system for providing power to drive the means for providing said displacement fluid.

* * * * *